US009015863B2

(12) United States Patent
Brown

(10) Patent No.: US 9,015,863 B2
(45) Date of Patent: Apr. 28, 2015

(54) ATHLETIC JERSEY

(76) Inventor: David W. Brown, Decorah, IA (US)

( * ) Notice: Subject to any disclaimer, the term of this patent is extended or adjusted under 35 U.S.C. 154(b) by 329 days.

(21) Appl. No.: 13/106,962

(22) Filed: May 13, 2011

(65) Prior Publication Data

US 2012/0284894 A1 Nov. 15, 2012

(51) Int. Cl.
*A41D 13/00* (2006.01)
*A41D 15/00* (2006.01)

(52) U.S. Cl.
CPC ..... *A41D 13/0015* (2013.01); *A41D 15/005* (2013.01); *Y10S 2/02* (2013.01)

(58) Field of Classification Search
CPC ..... A41B 13/10; A41B 13/106; A41B 1/08; A41D 27/04; A41D 1/18; A41D 27/06; A41D 27/24; A41D 15/005
USPC ..... 2/DIG. 2, 69, 69.5, 72, 74, 75, 77, 80, 2/86, 102, 105, 109, 113, 114, 133, 244, 2/247, 269
See application file for complete search history.

(56) References Cited

U.S. PATENT DOCUMENTS

| | | | | |
|---|---|---|---|---|
| 589,912 | A | 9/1897 | Stern | |
| 2,425,402 | A * | 8/1947 | Sieloff | 2/75 |
| 2,647,261 | A * | 8/1953 | Rassner | 40/586 |
| 2,890,460 | A | 6/1959 | Levi | |
| 3,155,985 | A | 11/1964 | Gallagher | |
| 3,492,676 | A | 2/1970 | King | |
| 3,574,237 | A | 4/1971 | Reynolds | |
| 4,078,265 | A | 3/1978 | Condit | |
| 4,277,848 | A | 7/1981 | Boehland | |
| 4,296,498 | A | 10/1981 | Vinson | |
| 4,453,274 | A | 6/1984 | Allen | |
| 4,686,714 | A | 8/1987 | Harley | |
| 5,029,344 | A | 7/1991 | Shannon et al. | |
| 5,241,705 | A | 9/1993 | Barney et al. | |
| 5,561,860 | A | 10/1996 | Nguyen-Senderowicz | |
| 5,694,651 | A | 12/1997 | Thomas | |
| 7,251,840 | B2 | 8/2007 | Bayer | |
| 7,441,281 | B2 | 10/2008 | Salem | |
| 7,707,857 | B1 | 5/2010 | McMurray et al. | |
| 7,814,574 | B2 | 10/2010 | Gheneva | |
| 2006/0143779 | A1 | 7/2006 | Lee | |
| 2007/0094762 | A1 * | 5/2007 | Carter et al. | 2/69 |
| 2010/0192276 | A1 | 8/2010 | Anderson | |

OTHER PUBLICATIONS

Lacrosse reversible practice jerseys—Google Search, Reversible Uniforms, accessed on Apr. 27, 2011, 4 pages.
S&S Worldwide; Reversible Pinnies, accessed on Apr. 27, 2011, 2 pages.

* cited by examiner

*Primary Examiner* — Amy Vanatta
*Assistant Examiner* — Sally Haden
(74) *Attorney, Agent, or Firm* — Merchant & Gould P.C.

(57) ABSTRACT

An athletic jersey has at least three selectable exterior appearances. In one example, the athletic jersey is sleeveless and formed of at least three panels having substantially the same shape and size that are fastened together at edges. The athletic jersey can be turned inside-out in several different ways to select between three or more different exterior appearances.

8 Claims, 10 Drawing Sheets

ATHLETIC JERSEY

BACKGROUND

Athletic jerseys are a type of garment commonly worn for various types of athletic events. In addition to providing a covering for the upper body, the jersey is useful for several other purposes. For example, an athletic jersey is to identify members of a team. Different colored jerseys can be worn by each team, permitting the players, fans, and officials to easily identify which player is on which team. A jersey can also be used to identify particular players, such as by including a player's name or a unique uniform number.

Athletic jerseys are sometimes also used during practices to divide members of the same team into different squads. For example, fifteen members of a team can be divided into three different squads of five players each. In order to more easily distinguish the members of each squad, solid-colored athletic jerseys can be assigned to each squad. For example, there may be a red squad, a white squad, and a blue squad. However, this requires that the team have quite a few practice jerseys of various colors. If each player has their own practice jerseys, they each have to have one of each of the three colors.

An alternative is to use a reversible jersey. In this example, a reversible jersey is used that has two colors. The jersey can be turned inside-out to switch between the colors. However, when the team is using a three-squad drill, one of the squads has to play without a jersey (sometimes referred to as "skins") Many players don't like to play without a jersey. Moreover, playing without a jersey is not an option for female players.

SUMMARY

In general terms, this disclosure is directed to athletic jerseys with at least three selectable exterior appearances. In one possible configuration and by non-limiting example, the athletic jersey is sleeveless and formed of three panels having substantially the same shape and size that are fastened together at edges. The athletic jersey can be turned inside-out in several different ways to select between three or more different exterior appearances.

One aspect is an athletic jersey comprising at least three fabric panels having opposing surfaces and a plurality of edges, the edges of each fabric panel including a neck opening edge, a torso opening edge, sleeveless arm opening edges, shoulder edges, and side edges, wherein at least portions of the fabric panels are coupled together at the shoulder edges and at the side edges.

Another aspect is a sleeveless athletic practice jersey comprising: a plurality of panels and seams. The plurality of panels includes at least one sheet of mesh fabric, and each of the panels has side edges, shoulder edges, sleeveless arm opening edges, neck opening edges, and torso opening edges. The plurality of panels include at least: a first panel including a first surface having a first color, and a second surface having a second color different from the first color; a second panel including a first surface having the second color, and a second surface having a third color different from the first and second colors; and a third panel including a first surface having the third color, and a second surface having the first color. The seams connect the panels and include a shoulder seam connecting the first panel, the second panel, and the third panel together at the shoulder edges; side seams connecting the first panel, the second panel, and the third panel together at side edges adjacent the arm opening edges and adjacent the torso opening edges; and edge seams at the sleeveless arm opening edges, neck opening edges, and torso opening edges; wherein the sleeveless athletic practice jersey is selectively adjustable between at least three different configurations, including a first configuration in which the athletic practice jersey has a first exterior appearance including the first color, a second configuration in which the athletic practice jersey has a second exterior appearance including the second color, and a third configuration in which the athletic practice jersey has a third exterior appearance.

DETAILED DESCRIPTION

Figure 1:
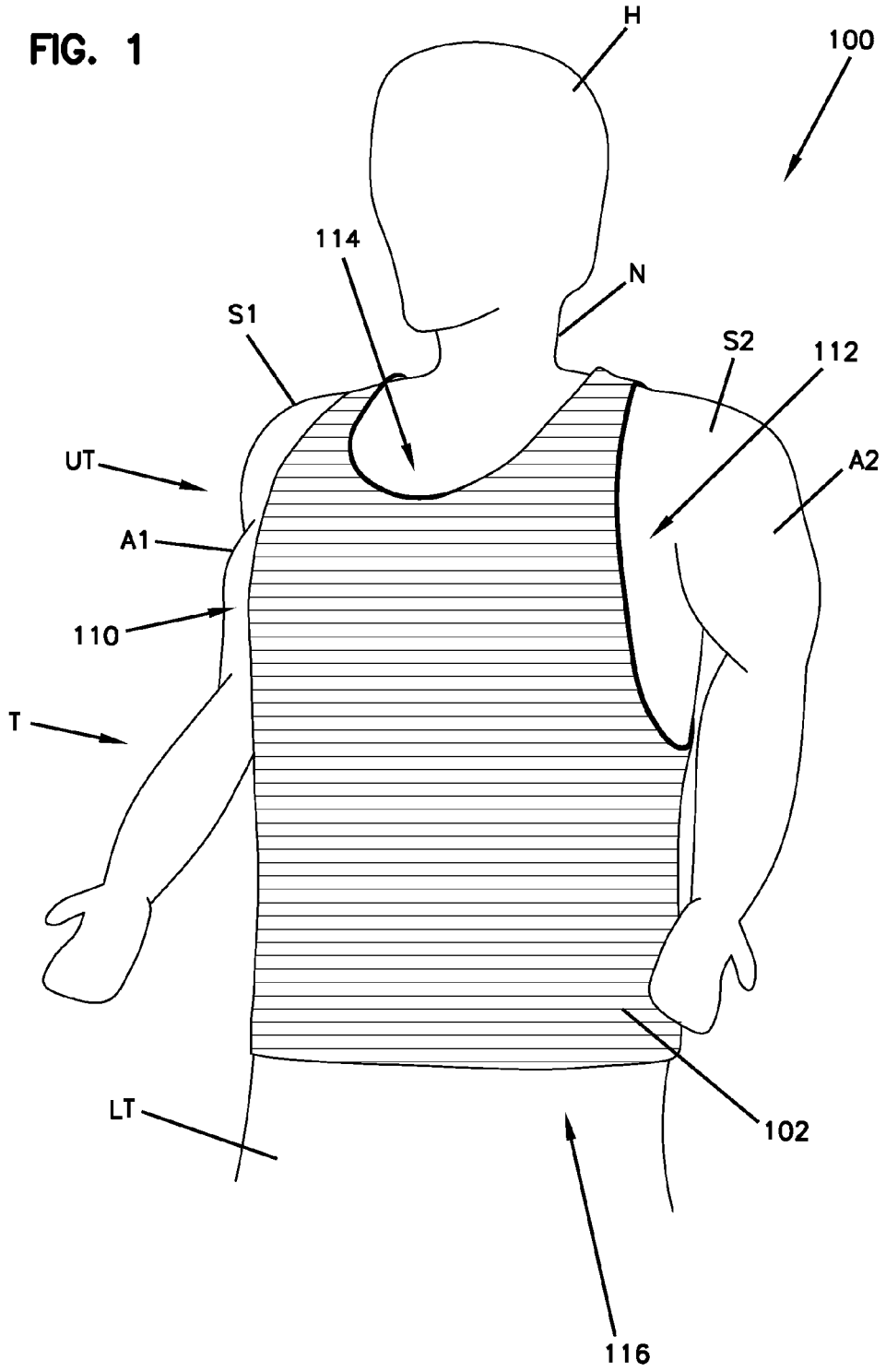
FIG. 1 is a perspective view of an example athletic jersey being worn by a person.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example athletic jersey 100 having multiple selectable exterior appearances that can be worn by a person P. One of the exterior appearances is as shown in FIG. 1.

As illustrated in FIG. 1, the person P has a head H, neck N, torso T (including an upper torso UT and a lower torso LT), shoulders S1 and S2, and arms A1 and A2.

Figure 2:
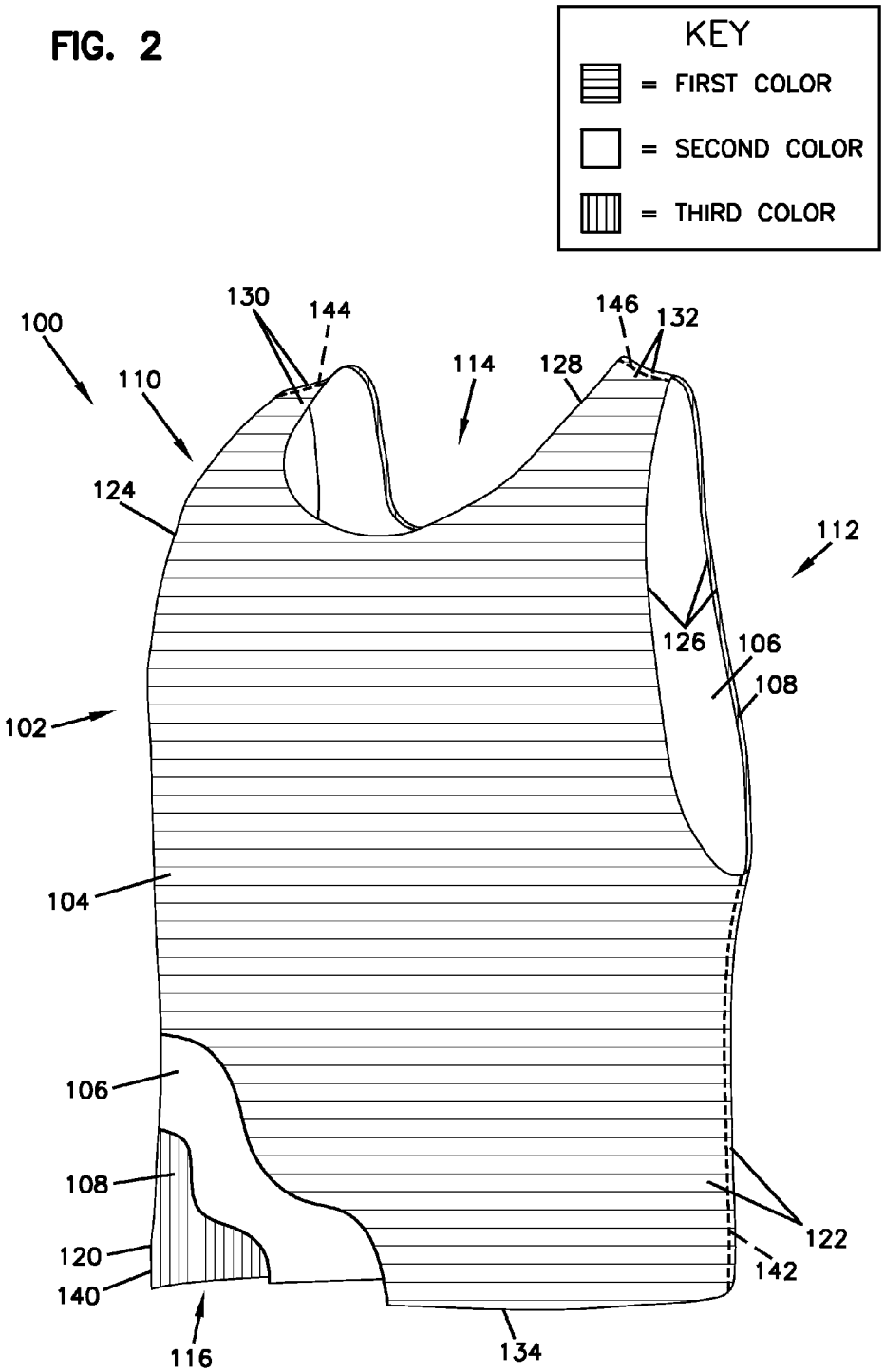
FIG. 2 is another perspective view of the example athletic jersey shown in FIG. 1.

The athletic jersey 100 is a fabric garment configured to be worn on the torso T of person P, as shown. In some embodiments, the athletic jersey includes at least three fabric panels 102 (including panels 104, 106, and 108, as shown in FIG. 2). The panels are shaped and connected together to define arm openings 110 and 112 for arms A1 and A2 and shoulders S1 and S2, neck opening 114 for head H and neck N, and torso opening 116 for the torso T.

In some embodiments, athletic jersey 100 is sleeveless. In some embodiments, athletic jersey 100 is a practice jersey. In other embodiments, athletic jersey 100 is a game jersey. In yet another embodiment, athletic jersey 100 is a fan jersey, such as to be worn by a spectator or fan of an athletic event.

In another possible embodiment, athletic jersey 100 is a pinnie. The pinnie has three or more exterior appearances, such as four, five, six, or more exterior appearances.

In some embodiments, the athletic jersey 100 is worn by players during a sports practice or game. Sports include basketball and lacrosse, and a wide variety of other possible sports (e.g., football, baseball, soccer, volleyball, cheerleading, etc.).

FIG. 2 is another perspective view of the example athletic jersey 100, including at least three fabric panels 102 (including panels 104, 106, and 108). As described with reference to FIG. 1, the fabric panels are shaped and connected together to define arm openings 110 and 112, neck opening 114, and torso opening 116.

In this example, the fabric panels 102 have a plurality of edges. The edges include side edges 120 and 122, arm opening edges 124 and 126, a neck opening edge 128, shoulder edges 130 and 132, and a torso opening edge 134. Some embodiments further include side seams 140 and 142 at side edges 120 and 122, as well as shoulder seams 144 and 146 at shoulder edges 130 and 132.

Figure 5:
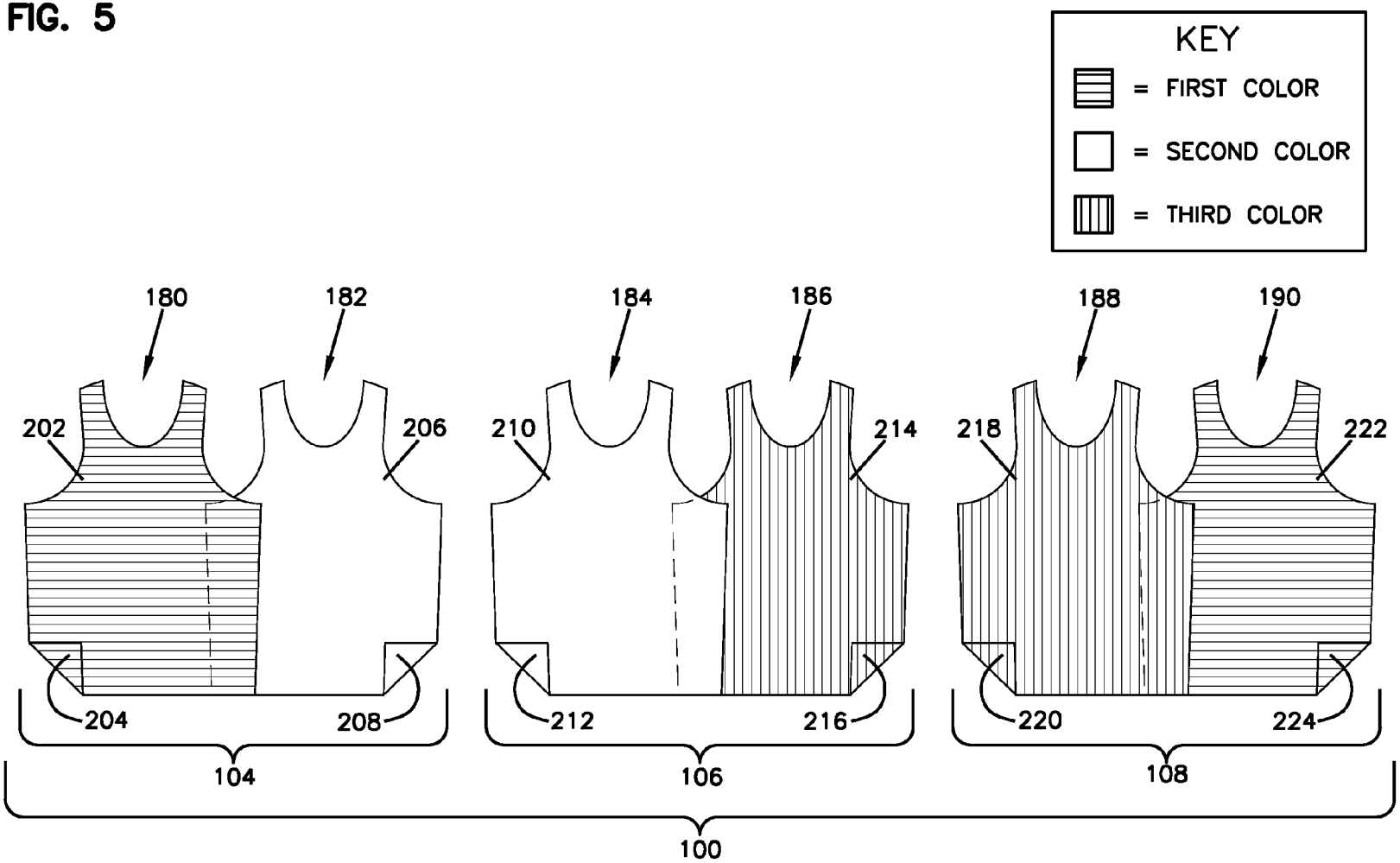
FIG. 5 is an exploded plan view of another example athletic jersey.

The fabric panels 104, 106, and 108 are formed of one or more sheets of fabric. In the example shown in FIG. 2, each panel is made of a single sheet of fabric, but in other embodiments, such as shown in FIG. 5, each panel is made of two or more sheets of fabric. Sheets of fabric can be made of one or more pieces of fabric. For example, multiple pieces can be fastened together at edges (e.g., with a seam) to form a single sheet.

Fabrics can be formed of one or more materials. Examples of suitable fabric materials include nylon, polyester, spandex (also known as elastane), nylon mesh, polyester mesh, elastane mesh, cationic polyester, nylon stretch dazzle, cationic polyester pin dot mesh, polyester interlock double knit, or other fabrics or combinations of these or other materials.

In some embodiments, the fabric panels 102 are made of a mesh material having a plurality of breathe holes. The breathe holes reduce the overall weight of the jersey 100, while also improving air circulation through the jersey 100 making it cooler to wear and promoting drying. However, some embodiments do not have breathe holes.

The fabric panels 102 can be formed, for example, by cutting the panels from one or more sheets of material in the desired shape. In some embodiments, the cut edges are folded over and sewn to form edges having a clean appearance.

A torso opening 116 is defined by space between adjacent fabric panels, to permit the athletic jersey 100 to be worn on a person P, as shown in FIG. 1. For example, when in the configuration shown in FIG. 2, the panel 104 forms a front panel, and panels 106 and 108 form back panels. The torso T of the person P can be inserted into the torso opening 116 between the panel 104 and panel 106. Alternatively, the torso T can be inserted into the torso opening 116 between the panel 106 and panel 108, in which case panels 104 and 106 are arranged in the front of the person P, and panel 108 is behind the person P.

When the athletic jersey 100 is in the configuration shown in FIG. 2, it has a certain exterior appearance. In this example, the exterior appearance is the first color (e.g., blue). The athletic jersey 100 can be arranged into other configurations to provide different exterior appearances. For example, if the athletic jersey 100 is turned inside out at the torso opening 116 between panels 104 and 106, a different exterior appearance is provided. In this example, the athletic jersey 100 has the second color (e.g., white). On the other hand, if the athletic jersey 100 is turned inside out at the torso opening 116 between panels 106 and 108, yet another exterior appearance is provided. In this example, the athletic jersey 100 has the third color (e.g., red).

In some embodiments, panels 102 are connected together by seams or other fasteners. A seam is typically formed by weaving thread through the panels 102 at desired locations, such as using a needle. The seams can be formed manually by hand, or by the use of a sewing machine. Other types of seams are used in other embodiments, such as a seam formed by a heat sealer and/or adhesive. Other types of fasteners that can be used include buttons, snaps, zippers, staples, hook and loop fasteners, or other devices or processes suitable to connect fabric layers together.

In some embodiments, athletic jersey 100 includes side seams 140 and 142, and shoulder seams 144 and 146. Side seams are formed along the side edges 120 and 122 of the panels 102. In one embodiment the side seams 140 and 142 extend along the entire lengths of the side edges 120 and 122. Additional examples of such seams are illustrated and described with reference to FIGS. 4 and 6.

Figure 3:
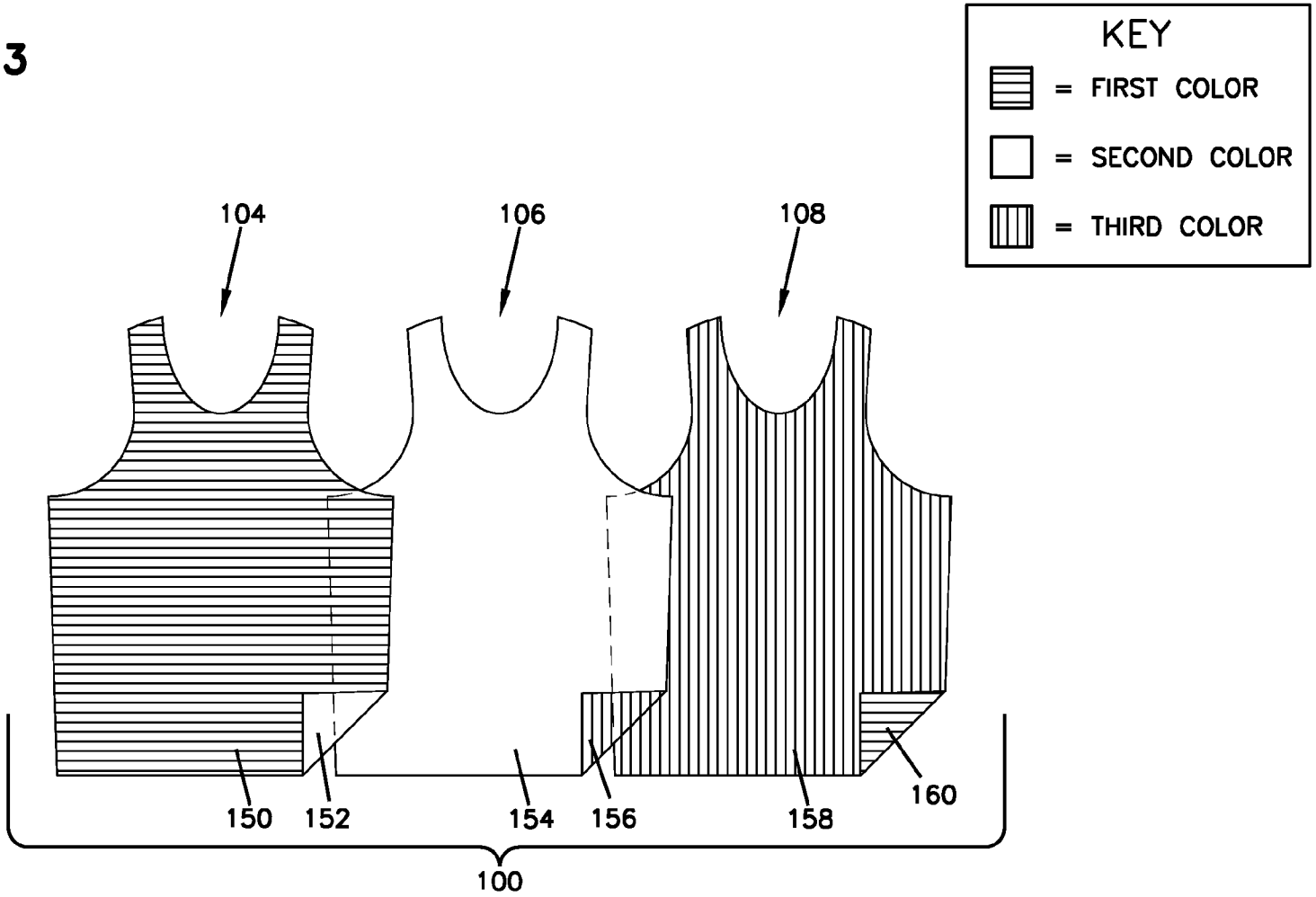
FIG. 3 is an exploded plan view of the example athletic jersey shown in FIG. 1.

FIG. 3 is an exploded plan view of an example athletic jersey 100. In this example, athletic jersey 100 is formed of panels 104, 106, and 108 formed of single sheets of materials.

Panels 104, 106, and 108 have two opposing surfaces, including first surfaces 150, 154, and 158, and second surfaces 152, 156, and 160. Each of the opposing surfaces has a different appearance.

As one example, each of the surfaces has a different color. Panel 104 has a first surface having a first color, and an opposing second surface 152 having a different second color. Panel 106 has a first surface 154 having the second color, and an opposing second surface 156 having a third color. Panel 108 has a first surface 158 having the third color, and an opposing second surface 160 having the first color.

An example of the first color is a solid blue color. An example of the second color is a solid white color. An example of the third color is a solid red color. Other embodiments have other colors or arrangements of colors on the various panels and surfaces. Further, in some embodiments the appearance of a surface may include different color schemes rather than different solid colors. For example, in some embodiments the athletic jersey has a first exterior appearance that matches the teams home color scheme (e.g., white with red lettering), and second and third appearances that match the teams traveling color schemes (e.g., red with white lettering, and blue with red lettering). In another embodiment, the athletic jersey has two home colors (e.g., yellow and white) and a dark away color (e.g., purple). Some embodiments have two light colors and one dark color, or two dark colors and one light color.

Various techniques can be used to obtain single-sheet panels having different appearances on opposing surfaces. One example is a process known as dye-sublimation. In this process, a sheet of material is passed through a dye-sublimation printer, which uses heat to transfer dye onto the appropriate surface of the material. The dye generates the desired appearance on the surface of the panel. If an appearance other than the original appearance of the material is desired on the opposing surface of the single-sheet panel, the dye-sublimation process can similarly be used to generate the desired appearance on that surface as well. Other coating, printing, or dying processes can be similarly used, or any other process capable of modifying the appearance of a sheet of fabric. In another possible embodiment, the material itself is made to have different appearances on opposing surfaces, such as by combining threads by weaving, knitting, crocheting, knotting, or fiber pressing operations to create the desired appearances.

As can be seen in FIG. 3, in some embodiments facing surfaces of adjacent panels share a common appearance. For example, the second surface 152 of panel 104 faces the first surface 154 of adjacent panel 106, and both surfaces 152 and 154 share the second color. Similarly, the second surface 156 of panel 106 faces the first surface 158 of panel 108, and both surfaces 156 and 158 share the third color. Additionally, when the athletic jersey is turned inside-out, the first surface 150 of the panel 104 faces the second surface 160 of the panel 108, and both share the first color.

Figure 4:
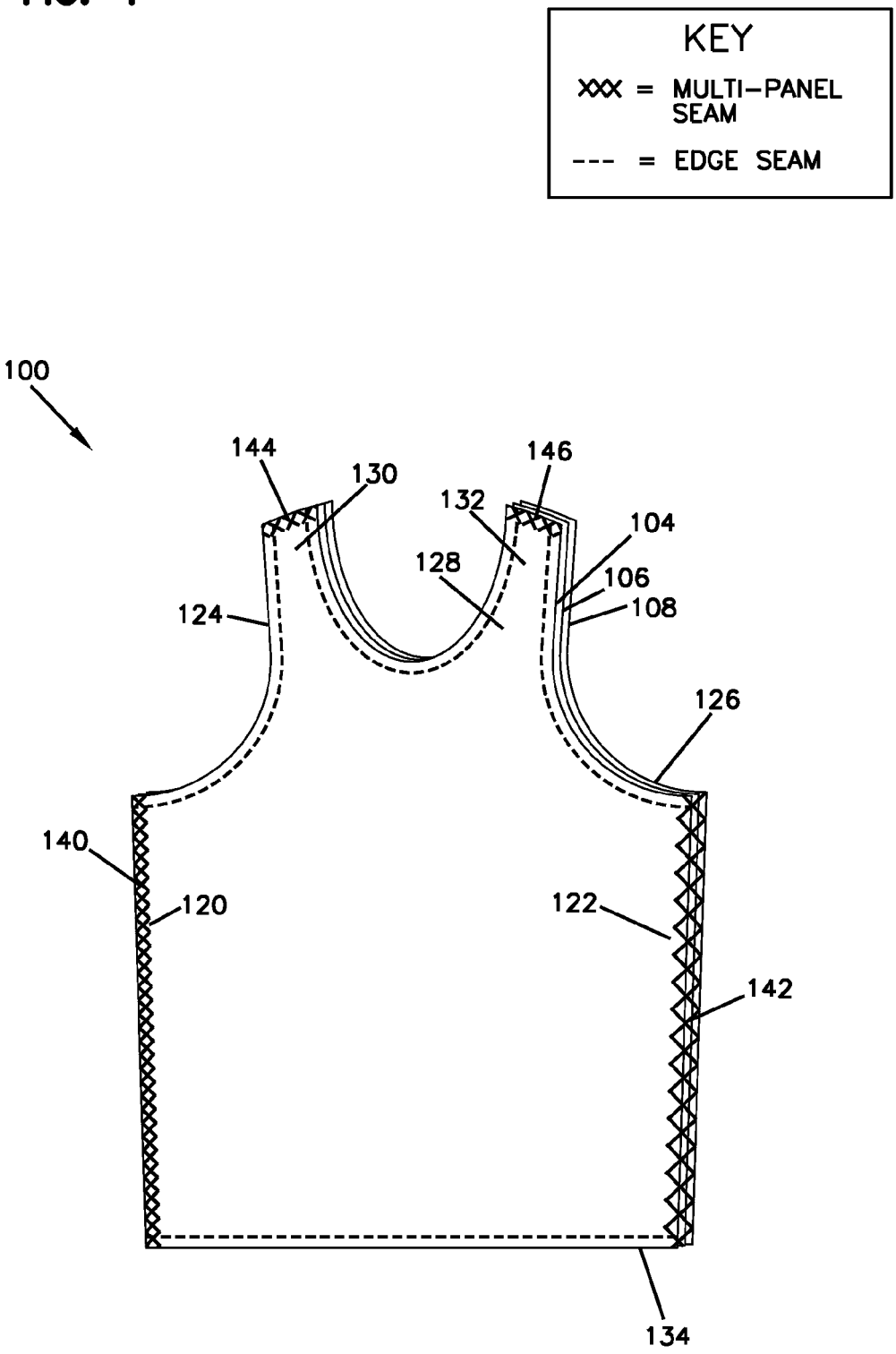
FIG. 4 is a schematic plan view of the example jersey shown in FIG. 1.

FIG. 4 is a schematic plan view of the example athletic jersey 100, shown in FIG. 3, and illustrating connections between the panels 104, 106, and 108. In this description the connections are described by way of example in terms of seams, but other fasteners are used in other embodiments.

In this example, the athletic jersey 100 includes panels 104, 106, and 108, and a plurality of seams. The panels each include side edges 120 and 122, arm opening edges 124 and 126, a neck opening edge 128, and shoulder edges 130 and 132. The seams include multi-panel seams and edge seams.

Multi-panel seams are provided to connect all of the panels together. In this example, the athletic jersey has multi-panel seams at side edges 120 and 122 and at shoulder edges 130 and 132.

Edge seams are used in some embodiments to provide a clean appearance at exposed edges of the panels 100. The edge seams do not connect adjacent panels together. When edge seams are used, the panels are cut slightly larger than the desired final size of the panel, and then a segment adjacent the edge is folded over and fastened with an edge seam. The fold line becomes the finished edge for the athletic jersey 100. In the example shown in FIG. 4, edge seams are provided at arm opening edges 124 and 126, neck opening edge 128, and torso opening edge 134. In some embodiments, another piece of fabric is used to form a collar at the opening, which can have the same color as the adjacent sheet, or a different color. Examples of collars include a neck opening collar (FIG. 8), arm opening collars, and a torso opening collar.

FIG. 5 is an exploded plan view of another example athletic jersey 100. In this example, athletic jersey 100 is formed of panels 104 ("first panel"), 106 ("second panel"), and 108 ("third panel"), which are each formed of at least two sheets of material. Panel 104 includes sheets 180 ("first sheet") and 182 ("second sheet"). Panel 106 includes sheets 184 ("third sheet") and 186 ("fourth sheet"). Panel 108 includes sheets 188 ("fifth sheet") and 190 ("sixth sheet"). Each sheet has two opposing surfaces, including first surfaces 202, 206, 210, 214, 218, and 222, and second surfaces 204, 208, 212, 216, 220, and 224.

In this embodiment, each panel is formed of at least two sheets of material. In some embodiments, each of the sheets has the same (or substantially similar) appearance on opposing surfaces, but each sheet in the panel has different appearances. For example, panel 104 includes sheets 180 and 182. Sheet 180 has first and second surfaces 202 and 204 that have the same appearance, such as a first color (e.g., blue). Sheet 182 has first and second surfaces 206 and 208 that have the same appearance, such as a second color (e.g., white). Accordingly, the appearance of the first sheet 180 is different than the appearance of the second sheet 182.

Panel 106 includes sheets 184 and 186. Sheet 184 has first and second surfaces 210 and 212 that have the same appearance, such as the second color (e.g., white). Sheet 186 has first and second surfaces 214 and 216 that have the same appearance, such as the third color (e.g., red).

Panel 108 includes sheets 188 and 190. Sheet 188 has first and second surfaces 218 and 220 that have the same appearance, such as the third color (e.g., red). Sheet 190 has first and second surfaces 222 and 224 that have the same appearance, such as the first color (e.g., blue).

Once the sheets are combined, however, opposing surfaces of the panel continue to have different appearances, just as in the example shown in FIG. 3. Panel 104 has two outer surfaces, including the first surface 202 of sheet 180 (having the first color), and the opposing second surface 208 of sheet 182 (having the second color). The first and second colors are different. Panel 106 has two outer surfaces, including the first surface 210 of sheet 184 (having the second color), and the opposing second surface 216 of sheet 186 (having the third color). The second and third colors are different. Panel 108 also has two outer surfaces, including the first surface 218 of sheet 188 (having the third color), and the opposing second surface 224 of sheet 190 (having the first color). The first and third colors are also different. As with the embodiment shown in FIG. 3, facing surfaces of adjacent panels share a common appearance.

Figure 6:
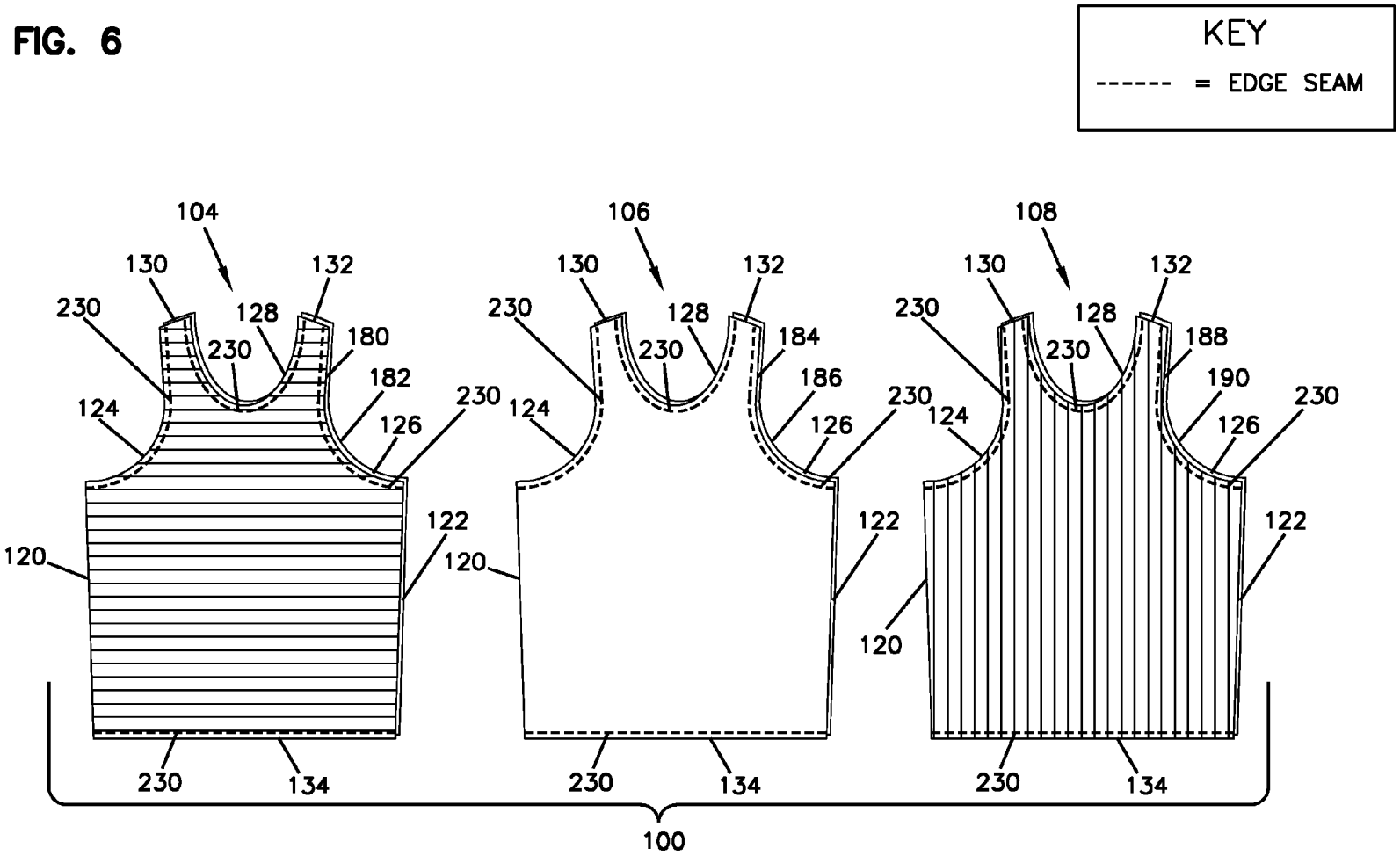
FIG. 6 is a partially exploded schematic plan view of the athletic jersey shown in FIG. 5 showing the connection of multiple sheets into individual panels.
Figure 7:
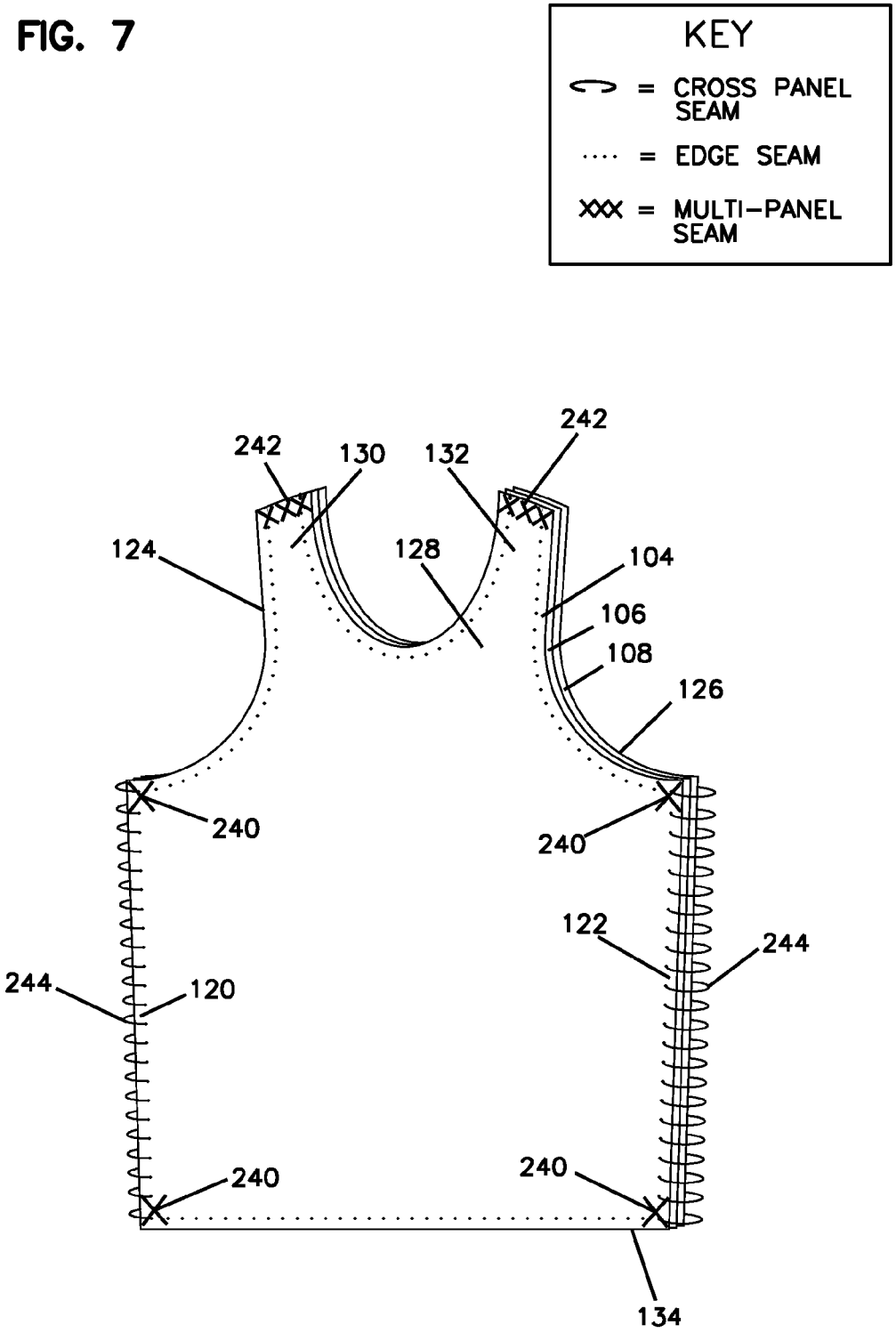
FIG. 7 is a schematic plan view of the example athletic jersey shown in FIGS. 5 and 6.

FIGS. 6 and 7 illustrate exemplary connections between material sheets and panels of the example athletic jersey 100 shown in FIG. 5.

FIG. 6 is a schematic plan view of the athletic jersey 100 illustrating the connection of multiple sheets into individual panels. The athletic jersey 100 includes panels 104, 106, and 108. The panel 104 includes sheets 180 and 182. The panel 106 includes sheets 184 and 186. The panel 108 includes sheets 188 and 190.

After the sheets have been cut to the desired shapes, the sheets are arranged into panels by placing one sheet on top of another, such that one surface of one of the sheets faces a surface of the other sheet. The sheets are then connected together with a fastener. Seams are described by way of example as a suitable fastener, but other fasteners are used in other embodiments.

In this example, the sheets are connected together with edge seams 230. The edge seams are sewn at least at each of the panel's opening edges, including the arm opening edges 124 and 126, the neck opening edge 128, and the torso opening edge 134. In another possible embodiment, the entire periphery of the panels is sewn with edge seams. In some embodiments, the sheets are cut slightly larger than the desired finished size and shape, and the excess edge portions of the sheets are folded inward prior to sewing to create edges having a finished appearance. Edges of each of the panels 104, 106, and 108 can be formed in the same manner, in some embodiments.

FIG. 7 is a schematic plan view of the example athletic jersey 100, shown in FIGS. 5-6, and illustrating connections between the panels 104, 106, and 108.

After edge seams 230 have been sewn into the panels 104, 106, and 108, the panels are connected together. One example seam arrangement is illustrated in FIG. 7, and includes multi-panel seams 240 and 242, and cross-panel seams 244.

Multi-panel seams 240 and 242 are provided to connect all of the panels 104, 106, and 108 together. In this example, the athletic jersey 100 includes multi-panel seams 240 located at or near to the tops of side edges 120 and 122 (adjacent arm opening edges 124) and the bottoms of side edges 120 and 122 (adjacent torso opening edges 134). In addition, shoulder edges 130 and 132 are connected with multi-panel seams 242.

Cross-panel seams 244 are provided to connect a sheet of one panel with another sheet of a different panel. More specifically, a sheet of one panel is connected to the other sheet that has the same appearance. Cross-panel seams 244 are formed at side edges 120 and 122.

With reference to the exemplary sheets shown in FIG. 5, the cross-panel seams 244 are provided to connect side edges of sheet 180 with side edges of sheet 190, which both share the first appearance. Additional cross-panel seams 244 are provided to connect side edges of sheet 182 with side edges of sheet 184 (both sheets 182 and 184 share the second appearance). Additional cross-panel seams 244 are provided to connect side edges of sheet 186 with side edges of sheet 188 (both of sheets 186 and 188 share the third appearance). In this way, each side edge 120 and 122 of each sheet is only connected to one other side edge of one other sheet.

In another possible embodiment, multi-panel seams can be used in place of the cross-panel seams 244, in which case all of the side edges of each panel are connected to side edges of each of the other panels.

Once the athletic jersey 100 has been assembled, it can be worn by a person P, as shown in FIG. 1. If a different exterior appearance is desired, the athletic jersey 100 can simply be flipped inside-out to select between the three or more available appearances. Some embodiments have three, four, five, six, seven, eight, nine, or ten different exterior appearances, for example.

In another possible embodiment, the athletic jersey 100 can be formed as follows. Sheets 180 and 190 can be connected together to form a first jersey portion, sheets 182 and 184 can be connected together to form a second jersey portion, and sheets 186 and 188 can be connected together to form a third jersey portion, where each of the jersey portions are connected together in jersey configurations. Then, the first, second, and third jersey portions can be arranged into the proper configuration (two inside the other), and fastened together at appropriate points or edges.

In another possible embodiment, some panels are formed of two or more sheets, while other panels are formed of only a single sheet. For example, in one embodiment an athletic jersey includes at least one panel formed of a single sheet, and another panel formed of two or more sheets. The single-sheet panel may have different exterior appearances on each of the two surfaces. A two- or more sheet panel may have different exterior appearances on each of the sheets.

Another example embodiment includes four panels, in which each panel is formed of a single sheet. Each sheet includes opposing surfaces, where the panels and surfaces can be arranged as follows: the first panel has a white surface and a blue surface, the second panel has a blue surface and a blue surface, the third panel has a red surface and a red surface, and the fourth panel has a red surface and a white surface. In this example, the second and the third panels are not connected at the torso opening, the arm openings, or the neck opening. As a result, the athletic jersey can be worn with any of three different exterior appearances, while always keeping an equal number of sheets in the front of the player as are in the back of the player, providing a balanced athletic jersey. Other exterior appearances can be used than these exemplary colors, and additional panels or layers can also be provided.

Figure 8:
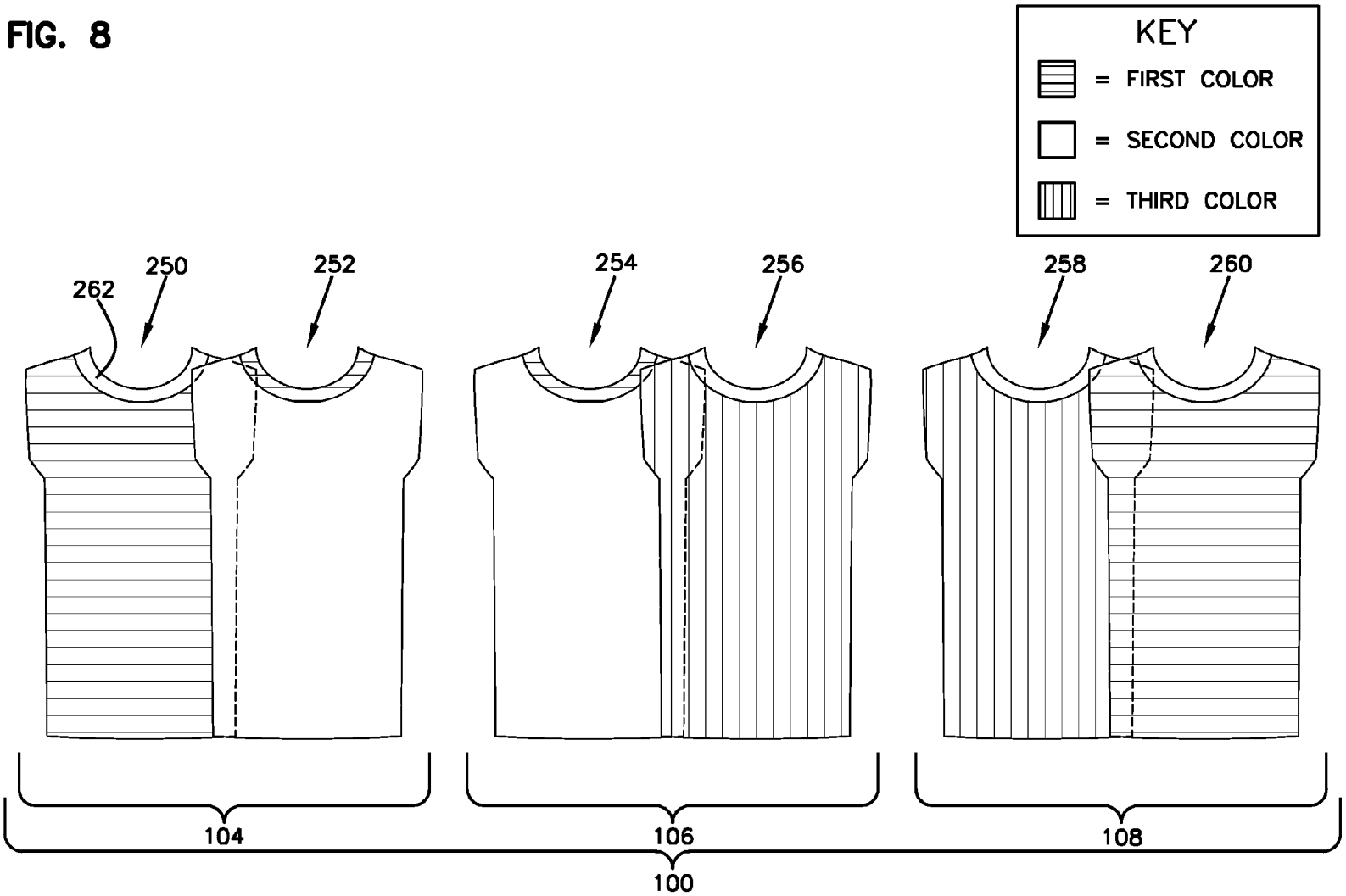
FIG. 8 is an exploded plan view of another example athletic jersey.

FIG. 8 is an exploded plan view of another example athletic jersey 100. In this example, the athletic jersey 100 is a game jersey. In some embodiments, the athletic jersey 100 has a different shape that can be referred to as a collegiate cut.

The game jersey may have a different shape than a practice jersey, such as having wider shoulder edges, slightly protruding arm opening edges, arm and/or neck opening collars, or a variety of other possible configurations. Some embodiments include side slits, where portions of side edges are not connected by a side seam. For example, in some embodiments the lower 2-3 inches of the side edges are not fastened to adjacent panels.

In addition, the example in FIG. 8 illustrates how each surface of each panel can include multiple colors. In this example, the athletic jersey still has at least three different appearances, but each of the appearances has at least two different colors. More specifically, the collar 262 has one color, and the rest of the sheet has another color.

For example, sheets 250 and 260 have a first color and a collar 262 having the second color. Sheets 252 and 254 have a second color and a collar having the first color. Sheets 256 and 258 have the third color and a collar having the second color. In some embodiments, sheets have multiple colors, and the collars can be any one (or more) of the colors, or even one or more different collars. In some embodiments, the sheets have a base scheme color pattern and the color of the collar matches the base scheme color pattern. A variety of other arrangements and appearances can be provided in other embodiments.

Figure 9:
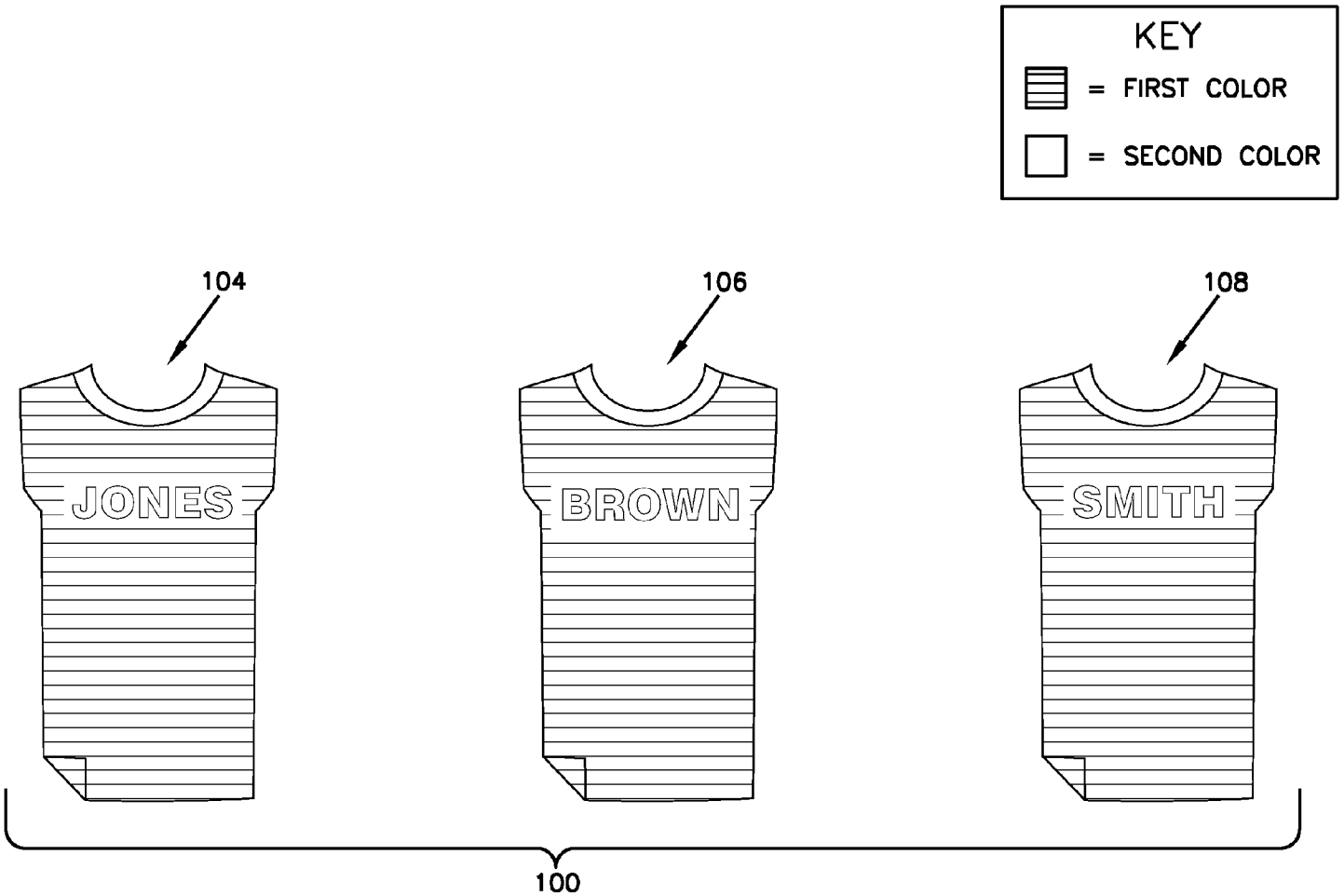
FIG. 9 is an exploded plan view of another example athletic jersey including printed indicia thereon.

FIG. 9 is an exploded plan view of another example athletic jersey 100. In this example, the athletic jersey 100 has several different selectable exterior appearances, but each of the appearances shares a common color scheme. The athletic jersey 100 includes panels 104, 106, and 108.

In this example, each of the panels 104, 106, and 108 have the same color scheme, such as having the first color with a collar having the second color. However, panels 104, 106, and 108 also include printed indicia, such as the names of players on a team. For example, panel 104 includes the name "Jones," panel 106 includes the name "Brown," and panel 108 includes the name "Smith." Therefore, although the panels each have the same color scheme, the exterior appearances are different due to the presence of different printed indicia on each of the panels.

An embodiment including player's names, may be worn by a fan at a sporting event (or any other location), for example, to permit the fan to selectively show support for a particular player. Even outside of a sporting event, the jersey permits the person to select between multiple different exterior appearances.

Other embodiments include other printed indicia, such as words (e.g., "go team," "boo," and "defense"; a team name; etc.), numbers, symbols, or other graphical elements. The printed indicia may be the same or different on the panels 104, 106, and 108.

Figure 10:
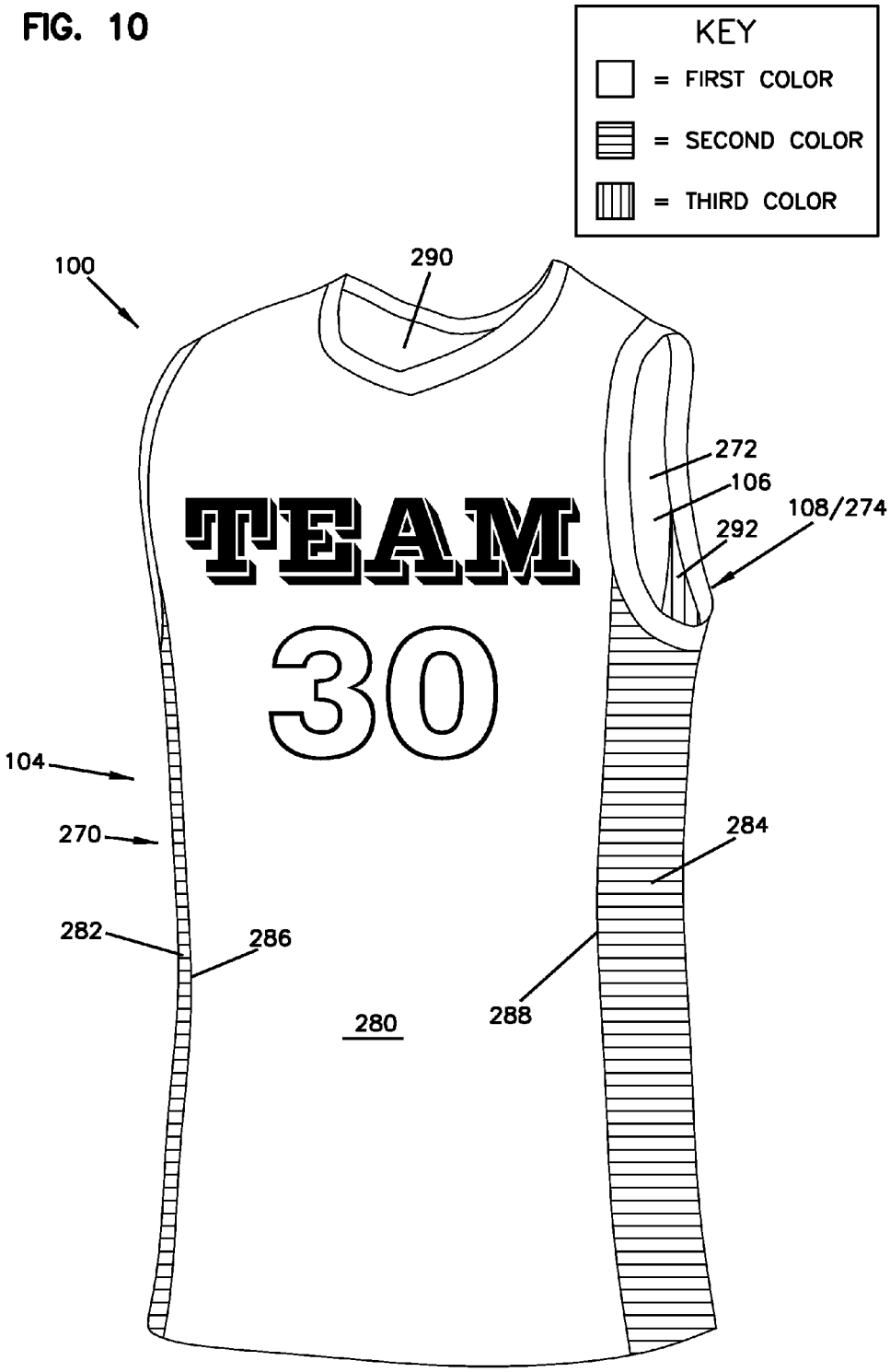
FIG. 10 is a schematic perspective view of another example athletic jersey illustrating an embodiment in which a sheet is formed of multiple sheet portions.

FIG. 10 illustrates an embodiment of the athletic jersey 100 in which one or more of the fabric sheets are formed of multiple partial sheets. In this example, the athletic jersey 100 includes at least three panels 104, 106, and 108, where each panel is formed of at least one sheet—panel 104 includes sheet 270, panel 106 includes sheet 272, and panel 108 includes sheet 274.

In some embodiments, sheets 270, 272, and 274 are formed of multiple sheet portions. For example, sheet 270 includes a central sheet portion 280, and two side sheet portions 282 and 284. Sheet portions 280, 282, and 284 can have the same or different colors. For example, sheet portion 280 has a second color (e.g., white), and side sheet portions have a first color (e.g., blue). The sheet portions 280, 282, and 284 are connected at seams 286 and 288 to form sheet 270.

Sheets 272 and 274 are similarly formed of multiple sheet portions in some embodiments. For example, sheet 272 is formed of a central sheet portion 290 and side sheet portions 292 (only one of the side sheet portions is visible in FIG. 10).

In some embodiments, a single sheet portion forms part of two or more sheets. For example, if a central vertical axis of sheet portion 284 is aligned with a side of athletic jersey 100, part of the sheet portion 284 (e.g., a forward part as shown in FIG. 10) may be part of the sheet 270, while another part of the sheet portion 284 (e.g., a rear part as shown in FIG. 10) may be a part of another sheet (e.g., sheet 274). In this example, the sheets 270 and 274 are not joined together with a side seam, but are joined together at the sides by the sheet portion 284. In this example, the central vertical axis forms an imaginary dividing line between the sheets 270 and 274.

The example athletic jersey 100 further illustrates an example in which the athletic jersey 100 includes both a neck opening collar as well as arm opening collars, which may be the same or different colors than the central sheet portion 280, or the side sheet portions 282 and 284.

Although the different external appearances of the various panels are typically described herein by way of example in terms of different solid colors (e.g., blue, white, red), the panels can have a variety of different appearances in other embodiments. The different appearances may include any one or more of the following: different sets of colors, different textures, different sets of textures, different materials, different sets of materials, different printed indicia, different sets of printed indicia, different sheet shapes, etc. Further, it should be recognized that panels may share some of these characteristics in common (e.g., they do not all have to be different on each panel). For example, in some embodiments all of the panels have the same color or sets of colors, but have different printed indicia. Alternatively, in some embodiments all of the panels have the same printed indicia, but have different colors or sets of colors.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A sleeveless athletic jersey comprising:

a plurality of panels, each of the panels including sheets of fabric, each of the sheets having a same size and shape and having side edges, shoulder edges, sleeveless arm opening edges, neck opening edges, and torso opening edges, the plurality of panels including at least a first panel including a first pair of sheets including a first sheet having at least a first color, and a second sheet having at least a second color different from the first color;

a second panel including a second pair of sheets including a third sheet having at least the second color, and a fourth sheet having at least a third color different from the first and second colors; and a third panel including a third pair of sheets including a fifth sheet having at least the third color, and a sixth sheet having at least the first color; and seams connecting the panels, the seams comprising edge seams connecting only the first pair of sheets together, only the second pair of sheets together, and only the third pair of sheets together at the arm opening edges and the neck opening edges to form the first, second, and third panels;

multi-panel seams connecting the first, second, and third panels together, the multi-panel seams being located at the shoulder edges and at least at a top and a bottom of the side edges; and cross panel seams connecting only two sheets of different panels having a same color, including connecting only the first sheet with the sixth sheet, only the second sheet with the third sheet, and only the fourth sheet with the fifth sheet;

wherein the sleeveless athletic jersey is selectively adjustable between at least three different configurations, including a first configuration in which the athletic jersey has a first exterior appearance including at least the first color, a second configuration in which the athletic jersey has a second exterior appearance including at least the second color, and a third configuration in which the athletic jersey has a third exterior appearance including at least the third color.

2. The sleeveless athletic jersey of claim 1, wherein the edge seams further connect only the first pair of sheets together, only the second pair of sheets together, and only the third pair of sheets together at the torso opening edges.

3. The sleeveless athletic jersey of claim 1, wherein the cross panel seams connect only the first sheet with the sixth sheet at the side edges, only the second sheet with the third sheet at the side edges, and only the fourth sheet with the fifth sheet at the side edges.

4. The sleeveless athletic jersey of claim 1, wherein:

in the first configuration, the first sheet of the first panel and the sixth sheet of the third panel forms the first exterior appearance while the second sheet of the first panel and the third sheet of the second panel are arranged to face each other in an interior of the athletic jersey defined by the first and second panels and while the fourth sheet of the second panel and the fifth sheet of the third panel are arranged to face each other in an interior of the athletic jersey defined by the second and third panels;

in the second configuration, the second sheet of the first panel and the third sheet of the second panel forms the second exterior appearance while the fourth sheet of the second panel and the fifth sheet of the third panel are arranged face each other in the interior of the athletic jersey defined by the second and third panels and while the first sheet of the first panel and the sixth sheet of the third panel are arranged to face each other in an interior of the athletic jersey defined by the first and third panels; and in the third configuration, the fourth sheet of the second panel and the fifth sheet of the third panel forms the third exterior appearance while the first sheet of the first panel and the sixth sheet of the third panel are arranged to face each other in the interior of the athletic jersey defined by the first and third panels and while the second sheet of the first panel and the third sheet of the second panel are arranged to face each other in the interior of the athletic jersey defined by the first and second panels.

5. The sleeveless athletic jersey of claim 1, wherein the first, second, and third panels each have different printed indicias thereon.

6. The sleeveless athletic jersey of claim 5, wherein the printed indicias are at least partial names of different players on a sports team.

7. The sleeveless athletic jersey of claim 5, wherein the fabric is mesh.

8. The sleeveless athletic jersey of claim 5, wherein the neck opening edges of each panel include a collar.

* * * * *